US006191753B1

(12) United States Patent
Ellis et al.

(10) Patent No.: US 6,191,753 B1
(45) Date of Patent: Feb. 20, 2001

(54) SYSTEMS AND METHODS FOR COVERING ANTENNAS USED IN DIGITAL SATELLITE COMMUNICATIONS SYSTEMS

(76) Inventors: Mark Ellis, 2171 Zell Rd.; Jeff Geer, 6742 Vista Dr., both of Ferndale, WA (US) 98248

( * ) Notice: Under 35 U.S.C. 154(b), the term of this patent shall be extended for 0 days.

(21) Appl. No.: 09/324,683

(22) Filed: Jun. 3, 1999

Related U.S. Application Data

(60) Provisional application No. 60/114,918, filed on Jan. 5, 1999.

(51) Int. Cl.[7] ..... H01Q 1/42
(52) U.S. Cl. ..... 343/872; 343/840
(58) Field of Search ..... 343/840, 872

(56) References Cited

U.S. PATENT DOCUMENTS

D. 304,454 11/1989 Serres .
D. 387,356 12/1997 Kelly et al. .
5,451,972 * 9/1995 Franklin ..... 343/840
5,528,253 * 6/1996 Franklin ..... 343/840
5,815,125 9/1998 Kelly et al. .
5,940,047 * 8/1999 Pfnister ..... 343/872

OTHER PUBLICATIONS

4–page website paper entitled SAT–Cover from Satcover, downloaded on Jul. 19, 1999.
3–page website paper entitled 'DSS' & 'DISH' Covers (Umbrella Deluxe Model 2) from Hobby Corner Satellite, downloaded on Jul. 19, 1999.

* cited by examiner

*Primary Examiner*—Tan Ho
(74) *Attorney, Agent, or Firm*—Michael R. Schacht; Hughes & Schacht, P.S.

(57) ABSTRACT

A rigid cover for satellite antennas. The cover prevents rain from passing between a dish member and a converter assembly of the satellite antenna. The cover may be designed for a particular style of satellite antenna or, preferably, have a mounting portion adapted to accommodate a plurality of styles of satellite antennas.

24 Claims, 14 Drawing Sheets

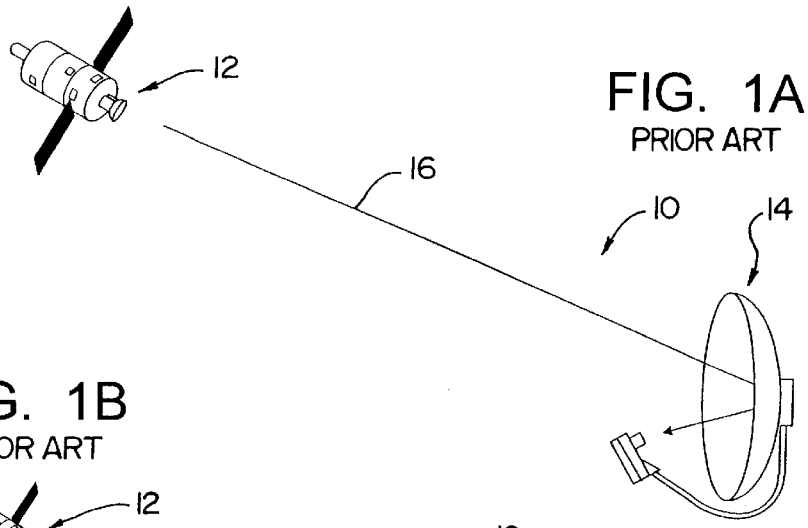
FIG. 1A
PRIOR ART
FIG. 1B
PRIOR ART
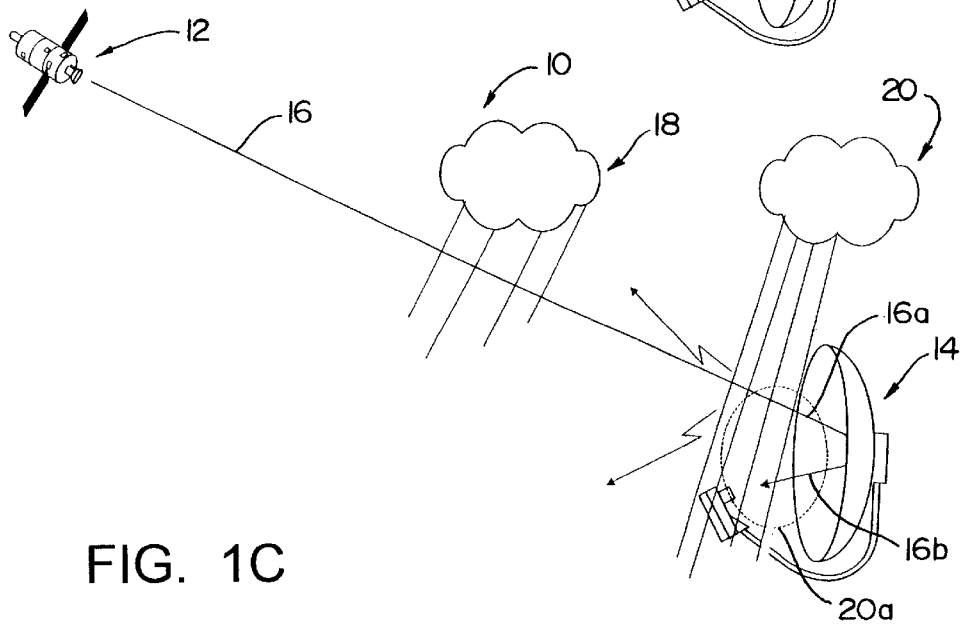
FIG. 1C
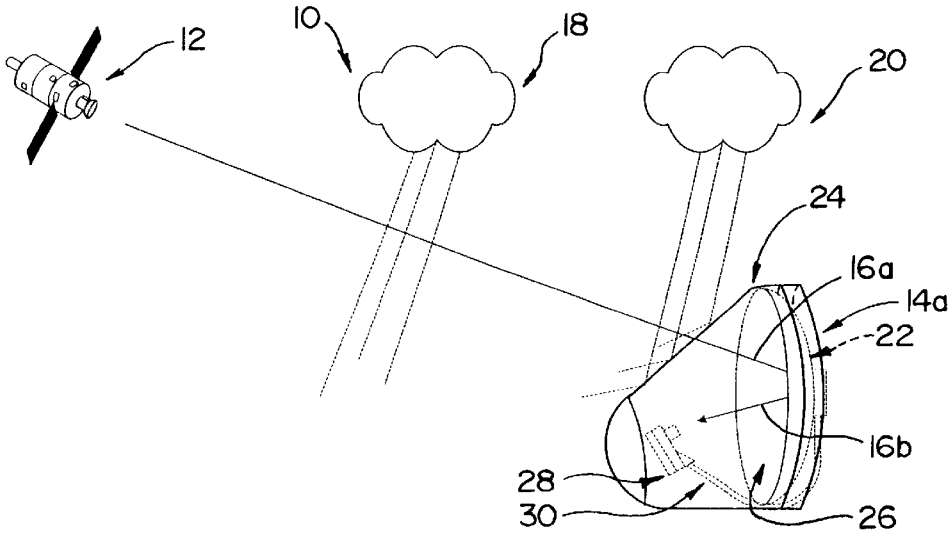

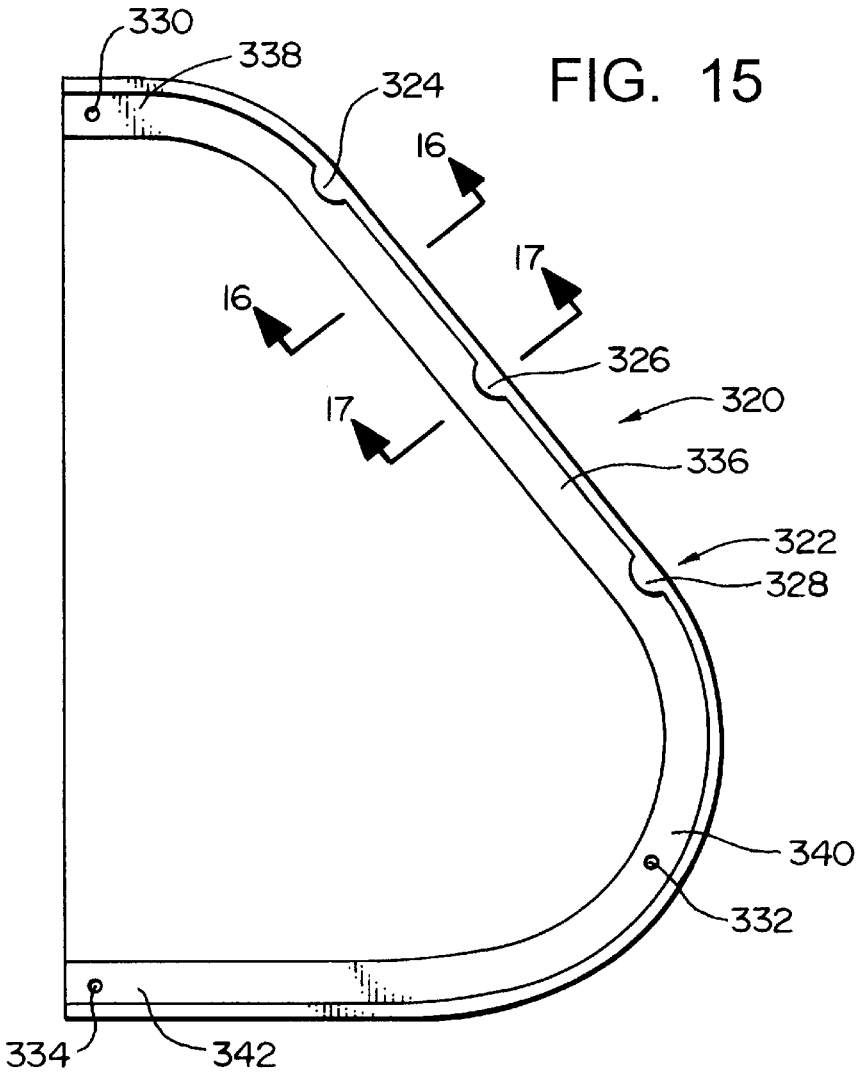
FIG. 15
FIG. 16
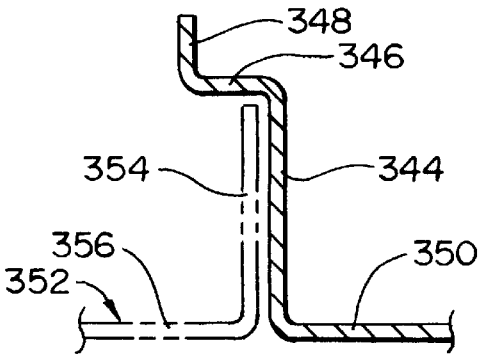
FIG. 17
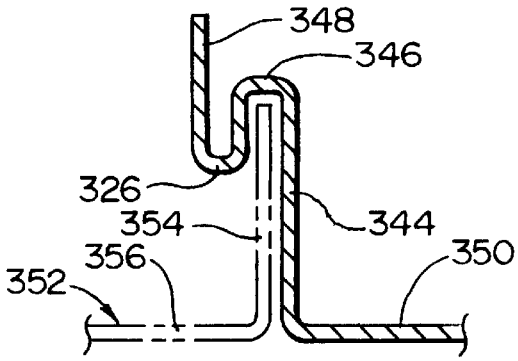

SYSTEMS AND METHODS FOR COVERING ANTENNAS USED IN DIGITAL SATELLITE COMMUNICATIONS SYSTEMS

This application claims the benefit of Provisional Application 60/114,918 filed Jan. 5, 1999.

TECHNICAL FIELD

The present invention relates to systems and methods for covering antennas and, more particularly, to systems and methods for covering parabolic dishes and converters used as part of digital satellite communications systems.

BACKGROUND OF THE INVENTION

Digital satellite communications systems employing digital television signals in the Ku microwave band (12 GHz) are increasingly popular for a number of reasons but principally because the frequencies employed allow small aperture antenna systems on the receiving end. Such small aperture receiving systems are highly desirable for home use.

The use of such high frequency signals increases the chance that these signals will be refracted or absorbed by moisture in the atmosphere as they propagate from the satellite to the receiving antenna. These systems are designed for a given amount of signal attenuation due to such interference, but excessive signal attenuation can result in an inadequate signal at the receiving location.

Accordingly, when localized precipitation causes signal attenuation beyond that for which the system was designed, the subscribers may experience what is called rain fade and eventually lose the transmitted signal entirely.

The need thus exists for systems and methods that alleviate the problem of signal loss due to moisture related interference.

RELATED ART

A device called a radome is commonly placed over antennas to protect the antenna from ice, snow, and wind. A common use of such radomes is on mountain top microwave relay stations in telephony communications networks. These radomes are typically heated and/or have special coating so that any accumulation of ice or snow on the cover is dissipated.

Similar radomes are attached to aircraft over aircraft radar antennas to protect the antennas while preserving the aerodynamic shape of the aircraft.

The applicant is also aware of a class of products specifically designed for digital satellite television systems that are, essentially, nylon bags that have drawstrings or a zipper. The bag is placed over the satellite dish and then drawn tight therearound. These bag type covers have several problems, however.

First, no matter how tight these bags are stretched over the dish, they eventually loosen and begin to collapse under the weight of rain or snow. Signal interference will likely occur when the bag collapses. In addition, the bags and drawstrings stretch and, in some cases, rot under a continuous exposure to moisture. Zipper type fasteners can rust or, if made of plastic, may not withstand the repeated stress from high winds. And these bag designs may not be used on antennas mounted on recreational vehicles because they can not withstand the constant and sustained wind force at highway speeds.

A search conducted by the applicant also turned up the following U.S. patents.

U.S. Pat. No. Des. 304,454 to Serres appears to disclose a bag type cover for satellite dishes.

U.S. Pat. No. Des. 387,356 to Kelly et al. discloses a satellite dish cover using a flexible bag.

U.S. Pat. No. 5,815,125 to Kelly also discloses a bag type satellite cover having a cinching mechanism for cinching and tightening the main body panel about the dish and feeder horn of satellite dish assembly.

OBJECTS OF THE INVENTION

From the foregoing, it should be apparent that a primary object of the present invention is to provide improved systems and methods for covering antennas used in digital satellite communications systems.

Another more specific object of the present invention is to provide systems and methods for covering antennas having a favorable mix of the following characteristics:

- reduces signal interference from precipitation falling between the antenna dish and the signal converter or collecting on the signal converter;
- easily adapts to a variety of antenna configurations
- can be installed quickly and inexpensively by a non-technician; and
- may be manufactured easily and inexpensively.

SUMMARY OF THE INVENTION

The present invention is a cover assembly for a parabolic antenna assembly designed for use in a satellite communications system. The cover assembly is designed with a mounting portion that engages the satellite dish and a nose portion that extends out from the satellite dish around a converter assembly of the antenna system.

The cover assembly is rigid and the nose portion will not buckle or fold under the weight of precipitation such as rain or snow. The cover assembly is made from a material that is impermeable to water and permeable to high frequency signals of the type to be received by the antenna system.

The mounting portion may be dedicated to one type of antenna assembly or may be designed with a plurality of mounting areas formed therein, with each mounting area being designed to attach to a different type of antenna assembly.

In particular, antenna dishes are sold in a number of different configurations. The mounting portion may comprise a mounting area that is sized and dimensioned to accommodate one of the dish configurations. Accordingly, the cover manufacturer need not manufacture and ship, and the retailer need not store and sell, a separate design for each type of antenna system.

The cover assembly is preferably made of first and second cover members that are attached to each other along a cover seam. This greatly facilitates manufacturing, storage, and assembly of the cover assembly over the antenna assembly, but a single piece cover member could be manufactured according to the principles of the present invention.

BRIEF DESCRIPTION OF THE DRAWINGS

FIG. 1A is a highly schematic view depicting a portion of a digital satellite system in which the present invention is used;

FIG. 1B is a similar highly schematic view depicting the climatic conditions that can create signal interference in a system such as that depicted in FIG. 1;

FIG. 1C is a highly schematic view depicting a portion of a digital satellite system constructed in accordance with, and implementing, the principles of the present invention.

FIG. 15 is side elevation view showing the interior of another exemplary cover member that can be used to form a cover assembly of the present invention, FIGS. 16 and 17 are enlarged section views of the cover member of FIG. 15 taken along lines 16—16 and 17—17, respectively, in FIG. 15;

DETAILED DESCRIPTION OF THE INVENTION

Figure 2:
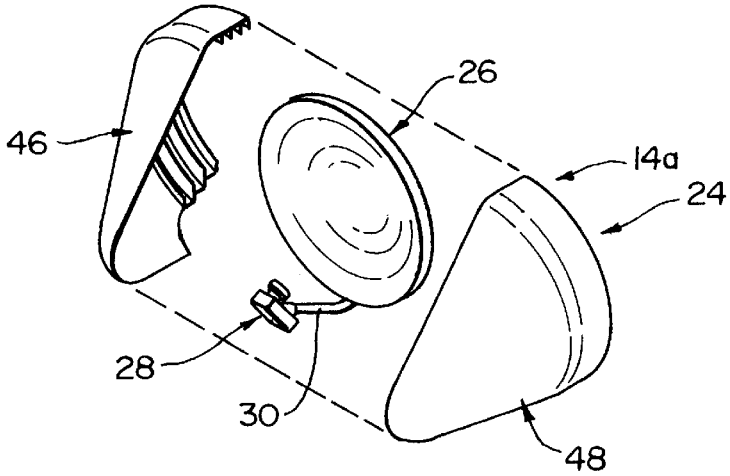
FIG. 2 is an exploded view depicting an antenna cover assembly constructed in accordance with, and embodying, the principles of the present invention.

Referring initially to FIG. 1A, depicted therein is a digital satellite system 10 in connection with which the present invention is used. This digital satellite system 10 is conventional and comprises a satellite 12 and a ground antenna system 14. The satellite 12 generates a radio signal 16 that is received by the antenna system 14. The antenna system 14 converts the radio signal 16 into an electrical signal appropriate for further processing and ultimately for display on an electronics device such as a computer or television.

Referring now to FIG. 1B, it can be seen that the radio signal 16 often passes through phenomena such as is generally indicated by reference characters 18 and 20. The phenomena depicted at 18 and 20 can be weather conditions such as clouds, precipitation, and the like that degrades or otherwise interferes with the signal 16 as it passes therethrough. The interference phenomena 18 will be referred to herein as distal interference, and the interference phenomena indicated by reference character 20 will be referred to herein as proximal interference.

The distal interference 18 is usually located at a point high above the antenna system 14. Nothing can be done by the operator of the antenna system 14 to alleviate this problem.

The proximal interference 20, however, results in an interference region 20*a* that is immediately adjacent to the antenna system 14. The interference region 20*a* is important for a number of reasons.

First, as shown in FIG. 1B, the signal 16 comprises a first portion 16*a* and a second portion 16*b*, and both of these portions 16*a* and 16*b* pass through the interference region 20*a*. The fact that the signal 16 passes twice through the interference region 20*a* intensifies the effect of any interference that occurs within this region 20*a*. In addition, the second signal portion 16*b* has been focused by the antenna system 14, which will disproportionately increase the effect of any interference that occurs within the interference region 20*a*.

The other primary factor that increase the importance of the interference region 20*a* is that precipitation or condensation, in the form of water, snow, frost, or ice, can build up on relevant portions of the antenna system 14 in this region 20*a*. Even a few drops of water at the right location will further degrade the signal 16 and in particular the focused second portion 16*b* of this signal.

Referring now to FIG. 1C, depicted therein is an exemplary antenna system 14*a* constructed in accordance with, and embodying, the principles of the present invention.

In the following discussion a component, element, feature, or step referred to herein by the term "exemplary" is not essential to the implementation of the present invention and can be replaced by another component, element, feature, or step that allows the present invention to perform the function described herein. Additionally, the term "preferred" indicates that a characteristic of a component, element, feature, or step described herein is disclosed for the purposes of describing the best mode for carrying out the purposes of the present invention, but does not mean that this characteristic is essential or required to implement the present invention.

The exemplary antenna system 14*a* comprises an antenna assembly 22 and an exemplary cover assembly 24. The cover assembly 24 allows the operator of the antenna system to exert limited control over the space immediately adjacent to the antenna system 14*a*. In particular, the cover assembly 24 covers the antenna assembly 22, which eliminates any interference region immediately adjacent to the system 14*a* and thus reduces the effects of the proximal interference 20 on the system 14*a*.

The satellite 12 is conventional and will not be described in detail herein. The antenna assembly 22 also is or may be conventional and will be described herein only to the extent necessary for a complete understanding of the present invention.

Figure 11:
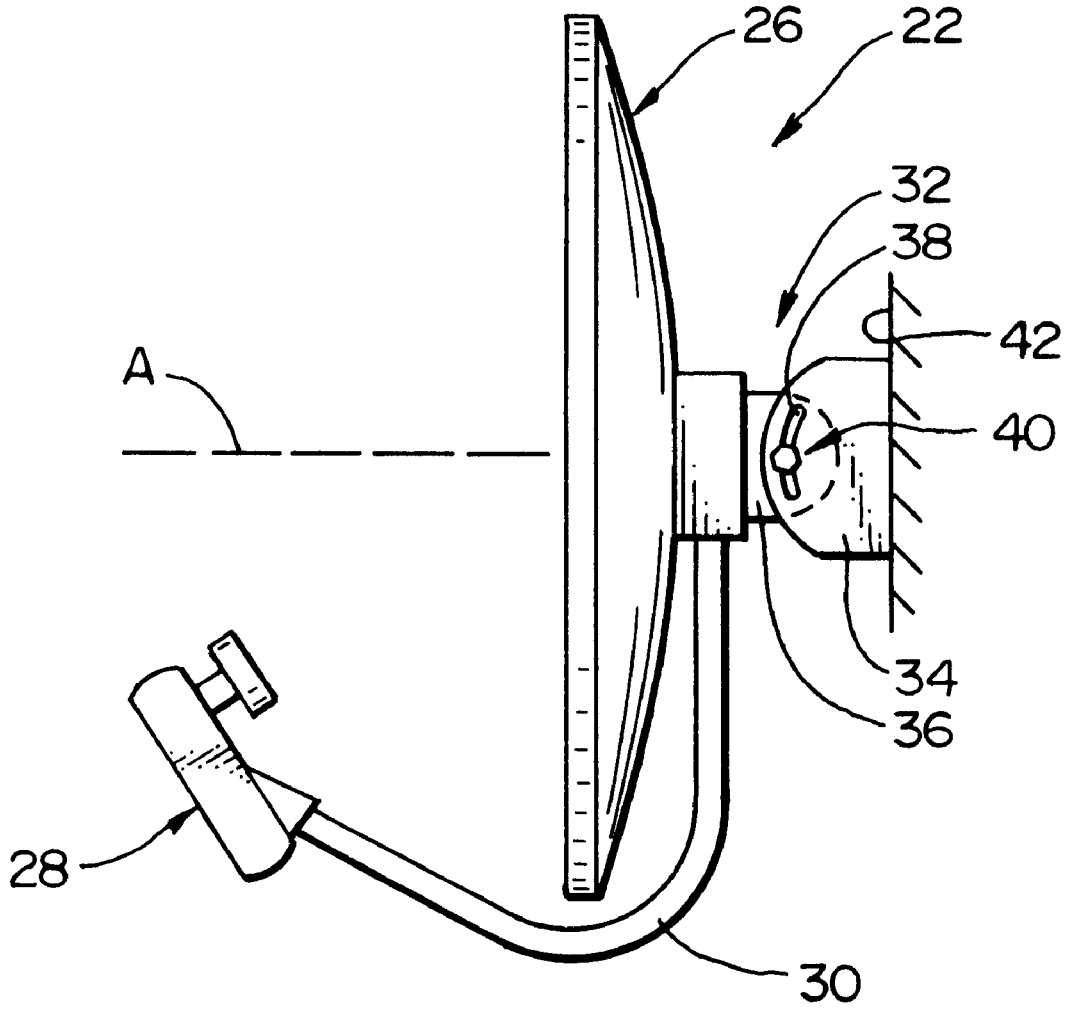
FIG. 11 PRIOR ART
FIG. 11 is a side, elevational, partial sectional view depicting one means by which the antenna assembly may be affixed to a structural member.

In particular, referring now to FIG. 11, depicted therein is a conventional antenna assembly 22 such as that which may be protected by the cover assembly 24. The antenna assembly 22 comprises a dish assembly 26, a converter assembly 28, a converter support arm 30, and an antenna mounting assembly 32. The exemplary antenna mounting assembly 32 is optional and comprises a fixed flange 34, a movable flange 36, an alignment groove 38, and a bolt assembly 40.

The dish assembly 26 is a round or elliptical section of a parabolic solid that reflects the first portion 16*a* of the signal 16 and directs the signal 16 at a focal point to obtain the second signal portion 16*b*. The converter support arm 30 is connected at one end to the dish assembly 26 and the other end to the converter assembly 28. The converter support arm 30 supports the converter assembly 28 at the focal point of the dish assembly 26. The converter assembly 28 forms a transducer that converts radio signals that propagate through the air into electrical signals that propagate over wires. As generally discussed above, the converter assembly 28 thus converts the second signal portion 16*b* into electrical signals appropriate for further processing and/or display by tuners, televisions, and/or computers.

The optional antenna mounting assembly 32 allows a system axis A defined by the dish assembly 28 to be closely aligned with the satellite 12 from which the signal 16 emanates. In particular, one of the fixed and movable flanges 34 and 36 is attached to the dish assembly 26, while the other of the fixed and movable flanges is attached to a structural member 42. The bolt assembly 40 passes through a hole in the movable flange 36 and the slot 38 in the fixed flange 34. Loosening the bolt assembly 40 allows the bolt assembly 40 to move within the slot 38 and thus the direction of the system axis A to be changed. The antenna mounting assembly 32 is not essential, and the dish assembly 28 may be directly attached to the structural member 42 in some situations.

With the foregoing understanding of the construction and operation of the antenna assembly 22 in mind, the details of the construction and operation of the exemplary cover assembly 24 will now be described.

Figure 9:
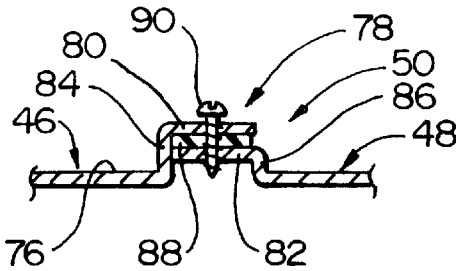
FIG. 9 is a section view of a fastening system taken along lines 9—9 in FIG. 3.

Referring initially to FIG. 2, it can be seen that the cover assembly 24 comprises a first cover member 46 and a second cover member 48. These members 46 and 48 are attached together at a cover seam 50 (FIG. 9). When the cover members 46 and 48 are attached together, a mounting portion 52 of the cover assembly 24 surrounds at least a portion of the dish assembly 26 to securely mount the cover assembly 24 onto the dish assembly 26.

Figure 3:
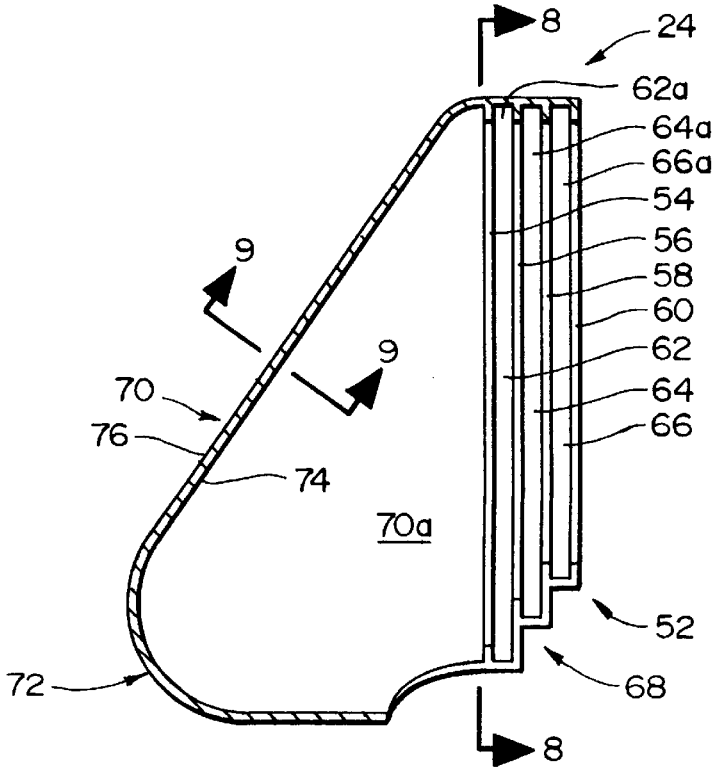
FIG. 3 is a vertical section view of the cover assembly of FIG. 2.

In particular, as perhaps best shown in FIG. 3, the mounting portion 52 of the exemplary cover assembly 24 defines first, second, third, and fourth retaining flanges 54, 56, 58, and 60. These retaining flanges 54–60 define first, second, third, and fourth mounting areas 62, 64, and 66. Any one of the mounting areas 62–64 can receive a portion of the dish assembly 26 to fix the cover assembly 24 relative to the antenna assembly 22.

Figure 7:
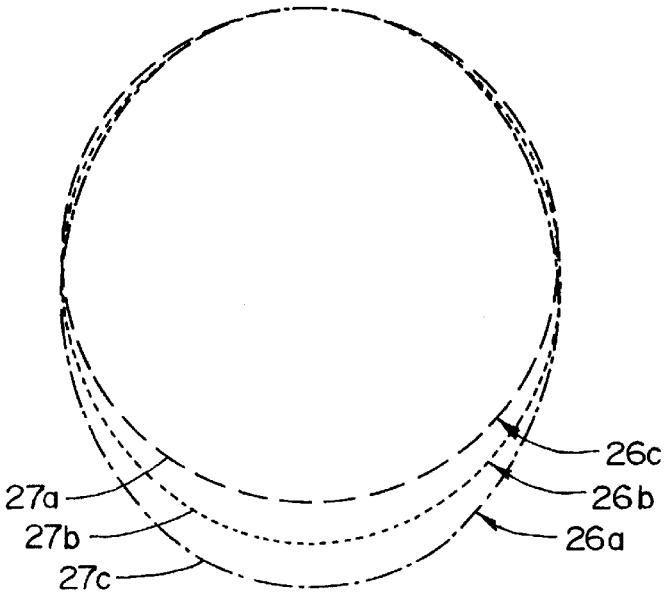
FIG. 7 is a diagram that depicts the antenna profiles for the three types of antennas depicted in FIGS. 4–6.

As generally described above, the dish assemblies 26 are round or oval sections of a parabolic solid. These dish assemblies 26 thus are configured differently depending upon the model and manufacturer. FIG. 7 depicts the first, second, and third effective shapes 27*a*, 27*b*, and 27*c* of three of the most common dish assemblies 26*a*, 26*b*, and 26*c* currently available in the marketplace. One can determine from FIG. 7 that the first effective shape 27*a* has a larger area than the second effective shape 27*b* and that the second effective shape 27*b* has larger area than the third effective shape 27*c*.

The mounting portion 52 of the exemplary cover assembly 24 allows the cover assembly 24 to be attached in any one of three configurations to a dish assembly 26*a*, 26*b*, or 26*c* having any one of the effective shapes 27*a*, 27*b*, or 27*c*. Of course, more than three dish assembly configurations can be accommodated simply by creating additional mounting areas. But the Applicant has determined that the three mounting areas 62, 64, and 66 of the exemplary cover assembly 24 are sufficient to accommodate the majority of commercially important dish assembly configurations.

Figure 4:
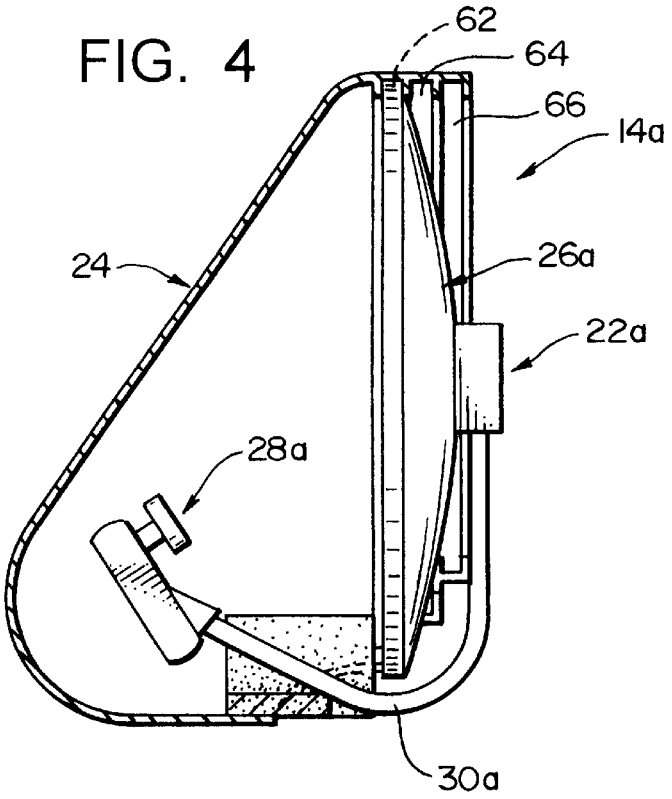
FIG. 4 is a vertical section view of the cover assembly of the present invention used on a first type of antenna assembly.
Figure 5:
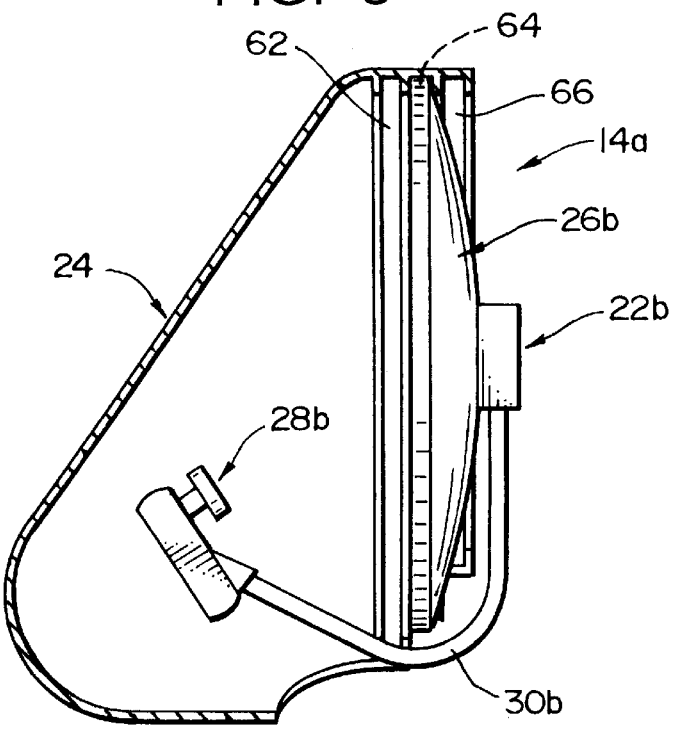
FIG. 5 is a vertical section view of the antenna cover of the present invention used on a second type of antenna assembly.
Figure 6:
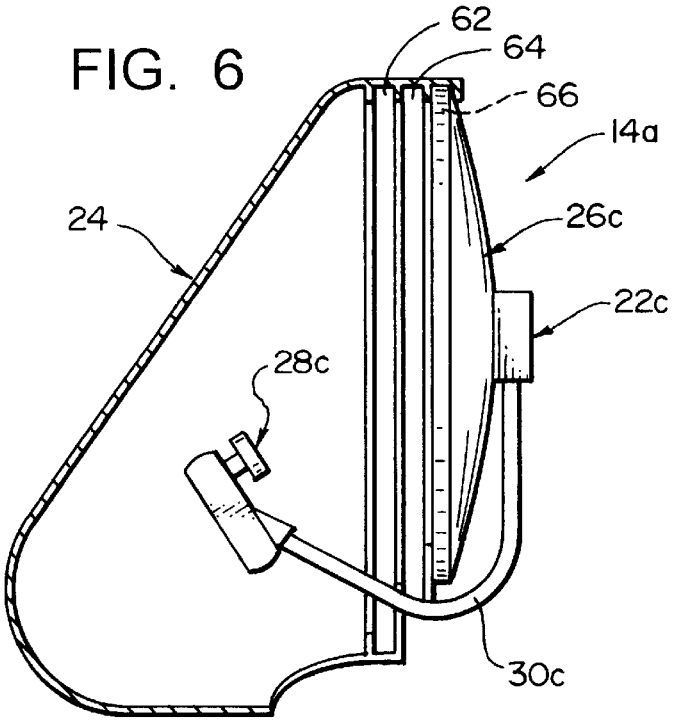
FIG. 6 is a vertical section view of the cover assembly of the present invention used with a third type of antenna.

In a first configuration shown in FIG. 4, a portion of a peripheral edge of the dish assembly 26*a* is received within the first mounting area 62. In a second configuration shown in FIG. 5, a portion of a peripheral edge of the dish assembly 26*b* is received within the second mounting area 64. And in a third configuration shown in FIG. 6, a portion of a peripheral edge of the dish assembly 26*c* is received within the third mounting area 64. In each of these three configurations, the first and second cover members 46 and 48 are securely joined together along the cover seam 50 to lock the cover assembly 24 onto the dish assembly 26.

The exact shape and dimensions of the cover assembly 24 are not critical, but certain aspects of the exemplary cover assembly 24 are important to allow this assembly 24 to function properly on the different dish assemblies 22 supported by the exemplary cover assembly 24.

In particular, a support arm notch 68 is formed in a lower portion of the cover assembly 24. And in addition to the mounting portion 52, the cover assembly 24 comprises a nose portion 70 and a tip portion 72. The exemplary nose portion 70 has the same general shape as a human nose, with the tip portion 72 being formed on the nose portion at a location distal from the mounting portion 52. The nose portion 70 defines a nose chamber 70*a* that accommodates the converter assembly 28 and a portion of the converter support arm 30. The nose portion 70 is thus configured such that the nose chamber 70*a* can accommodate the converter assembly 28 for each of the first, second, and third use configurations defined above with reference to FIGS. 4–6.

The support arm notch 68 allows the converter support arm 30 to pass unobstructed from behind the dish assembly 26 into the nose chamber 70*a* such that the converter assembly 28 is properly located at the focal point of the dish assembly 26. In some configurations, the cover assembly will completely enclose the portion of the support arm in front of the dish 26, and the support arm notch 68 may be unnecessary; instead, the support arm simply extends through the open back of the cover assembly.

The dimensions of these grooves 62–66 are important to obtain a snug fit around a particular dish assembly 26, but the exact dimensions of the exemplary grooves 62–66 are not required to implement the basic principles of the present invention.

In particular, the perimeter wall portions 62*a*, 64*a*, and 66*a* should substantially follow, but should be slightly larger than, a portion of the effective shape 27 of the dish assembly 26 the mounting area is designed to receive.

Figure 8:
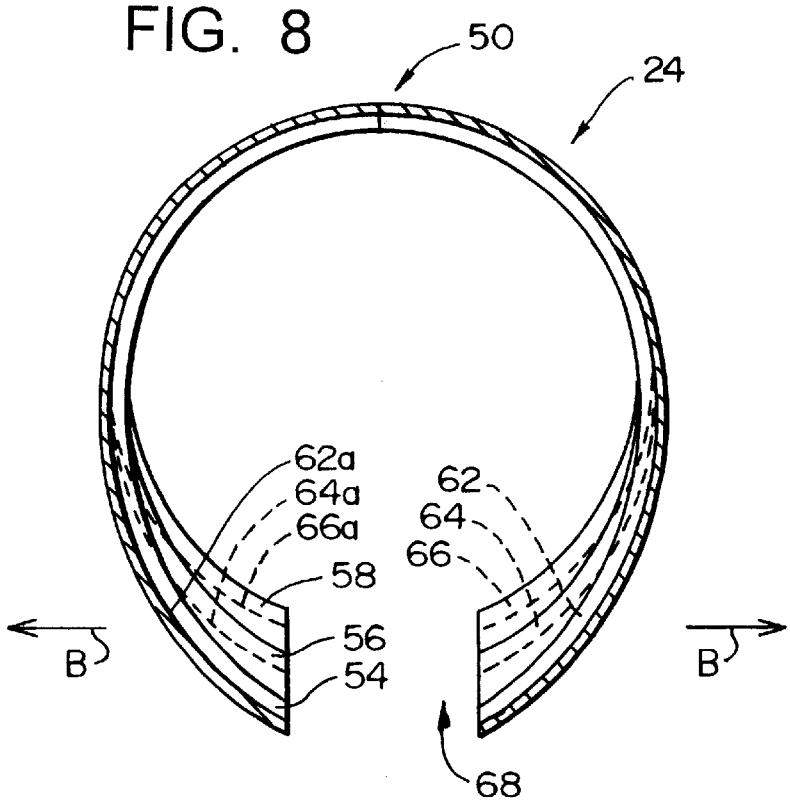
FIG. 8 is a vertical section view taken along lines 8—8 in FIG. 3.

In addition, as perhaps best shown in FIG. 8, the exemplary perimeter wall portions 62*a*, 64*a*, and 66*a* extend around substantially between 200–240° of the effective shape 27. The wall portions should preferably extend around substantially between 180–250° of the effective shape, but in any event should extend around at least 180° of the effective shape. While the perimeter wall portions 62*a*, 64*a*, and 66*a* would work in most conditions when surrounding less than 180° of the effective shape, this configuration would not maintain the cover assembly 24 on the antenna assembly 22 against upward loads.

The cross-sectional area of the mounting areas 62–66 are defined by the distances between the retaining flanges 54–60 and the distances that the flanges 54–60 extend from the perimeter wall portions 62*a,* 64*a,* and 66*a*. More specifically, the mounting area 62 is defined by the flanges 54 and 56 and a first perimeter wall portion 62*a*. The mounting area 64 is defined by the flanges 56 and 58 and a second perimeter wall portion 64*a*. The mounting area 66 is defined by the flanges 56 and 58 and a third perimeter wall portion 66*a*.

As perhaps best shown in FIG. 3, the tops of the perimeter wall portions 62*a,* 64*a,* and 66*a* of the mounting portion 52 are substantially arranged along a horizontal line and the bottoms of these wall portions 62*a,* 64*a,* and 66*a* are stepped up towards the back. Optionally, the centers of the perimeter wall portions 62*a,* 64*a,* and 66*a* could be aligned along a common axis or the bottoms of the wall portions could be horizontally aligned.

The mounting areas 62–66 are preferably formed such that the smallest groove 66 is arranged towards the back of the cover assembly 24, but these could also be formed such that the smallest groove 66 is towards the front. As an alternative, either the smallest groove 66 or the largest groove 62 could be arranged between the other two grooves, in which case the middle-sized groove 64 could be arranged at the front or the back.

Referring again for a moment to FIG. 3, it can be seen that the cover assembly 24 defines an inner surface 74 and an outer surface 76. The inner surface 74 is preferably slightly downwardly slanted so that any moisture collecting thereon drains out of the nose chamber 70*a* through the support arm notch 68. The outer surface 76 is also slanted or curved downwardly so that moisture, snow, and the like does not tend to collect thereon.

The cover assembly 24 is preferably made of molded plastic that is weather resistant, is impermeable to water, has low friction surfaces, and is permeable to the signal 16. Preferably, this material is ABS plastic or High Density Polyethylene (HDPE) and is manufactured by a thermoformed process, but other materials and manufacturing processes may be used.

The shape of the cover assembly 24 should be aerodynamic to prevent high winds from placing unnecessary loads on the antenna mounting assembly such as the assembly 32 described above. In this context, it should be noted that, under static loads, the cover assembly 24 will add slightly to the load carried by the antenna mounting assembly. But the aerodynamically designed cover assembly 24 will reduce the loads carried by the antenna mounting assembly under the worst case dynamic loads caused by high winds and the like.

The cover assembly 24 may be made as a single part rather than comprising the first and second cover members 46 and 48 described above. A single part cover assembly may be made flexible enough that it can be deformed as shown by arrows B in FIG. 8 for mounting onto the dish assembly 26. The exemplary two part cover assembly 22 is preferable, however, because it may be manufactured, shipped, stored, and assembled more conveniently.

The use of a two part cover assembly is facilitated by the use of fastening system such as that the exemplary cover system shown at 78 in FIG. 9 to join the cover members 46 and 48 at the seam 50. The fastening system 78 comprises an outer step portion 80 formed on one of the first and second cover members 46 and 48, an inner step portion 82 formed on the other of the cover members 46 and 48, a first intermediate portion 84 adjacent to the outer step portion 80, a second intermediate portion 86 adjacent to the inner step portion 82, an optional seal member 88, and a plurality of fasteners such as the screw 90 depicted in FIG. 9.

The first intermediate portion 84 spaces the outer step portion 80 a first predetermined distance from the outer surface 76 of the cover assembly 24, while the second intermediate portion 86 spaces the inner step portion 82 a second predetermined distance from the cover assembly outer surface 76.

The difference in the first and second predetermined distances allows the outer step portion 80 to overlap the inner step portion 82. This overlap may, by itself, create a sufficiently water proof seal at the seam 50. The fasteners 90 extend through the step portions 80 and 82 to fix the location of the first cover member 46 relative to the second cover member 48.

The optional seal member 88 may be arranged between the step portions 80 and 82 to improve the seal therebetween. This seal member may be a single or double sided adhesive strip of compressible material. A double sided adhesive strip may obviate the need for the fasteners 90.

The fasteners 90 may be metal screws as shown or other fasteners such as plastic parts that may be inserted through narrow grooves and turned to fix the cover members relative to each other. A plastic part could have an increasing thickness portion that exerts greater force on the cover members as the part is turned, which would increase friction between the plastic fastener part and the cover member.

Figure 10:
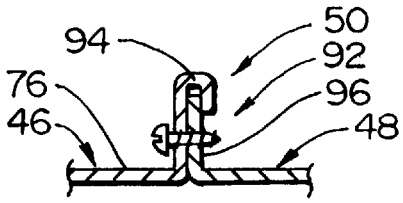
FIG. 10 is a section view of another fastening system taken along lines 9—9 in FIG. 3.

Another exemplary fastening system is shown at 92 in FIG. 10. This system 92 comprises a retainer portion 94 defining a retainer groove 96 and a flange portion 98. The retainer portion 94 is formed on one of the first and second cover members 46 and 48, and the flange portion 98 is formed on the other of the cover members 46 and 48.

The retainer portion 94 and the flange portion 98 are sized and dimensioned relative to each other such that the flange portion 98 is snugly received within the retainer groove 96. The flange portion 98 and retainer groove 96 radially extend from the cover assembly 24 (i.e., substantially orthogonal to the outer surface 76).

Fasteners such as the fasteners 90 described above may be passed through the retainer portion 94 and flange portion 98 to ensure a solid connection between the cover members 46 and 48. An optional seal member such as the seal member 88 described above may be arranged between the retainer portion 94 and the flange portion 98.

The cover assembly 24 is attached to the antenna assembly 22 in the following manner. First, the installer must decide which of the mounting areas 62–66 most appropriately fits the particular antenna assembly 22 to which the cover assembly 24 is to be attached. The installer then displaces one of the first and second cover members 46 and 48 such that an edge of the dish assembly 26 is received within the appropriate mounting area as determined above. The other of the first and second cover members is then displaced such that the appropriate groove therein receives the other edge portion of the dish assembly 26. The outer and inner step portions 80 and 82 are then arranged such that the outer step portion 80 overlaps the inner step portion 82 with any holes for the fasteners 90 aligned. Any fasteners 90 are then inserted through the holes therefore and tightened to secure the cover members 46 and 48 together.

Referring again for a moment to FIG. 4, depicted at 100 therein is an optional plug that may be used to substantially close the support arm notch 68 through which the support arm 30 extends. The exemplary plug 100 is a soft, compressible, generally u-shaped piece of synthetic foam material that at least partially surrounds the support arm 30 at the notch 68. When the plug 100 is in place, wildlife such as birds, bees, squirrels, and the like will not be able easily to enter the nose chamber 70*a* and interfere with the operation of the antenna assembly 22 by building nests and the like.

Even in cover assembly configurations in which the support arm is not provided, a plug such as the plug 100 may be used because many embodiments of a cover assembly constructed in accordance with the present invention will not form a tight fit around the support arm.

The plug may be made of a more rigid material such as styrofoam, plastic or the like, but these more rigid materials may need to be specifically manufactured for a given antenna type because they do not have the resiliency to conform to an undetermined support arm shape and location.

Figure 12:
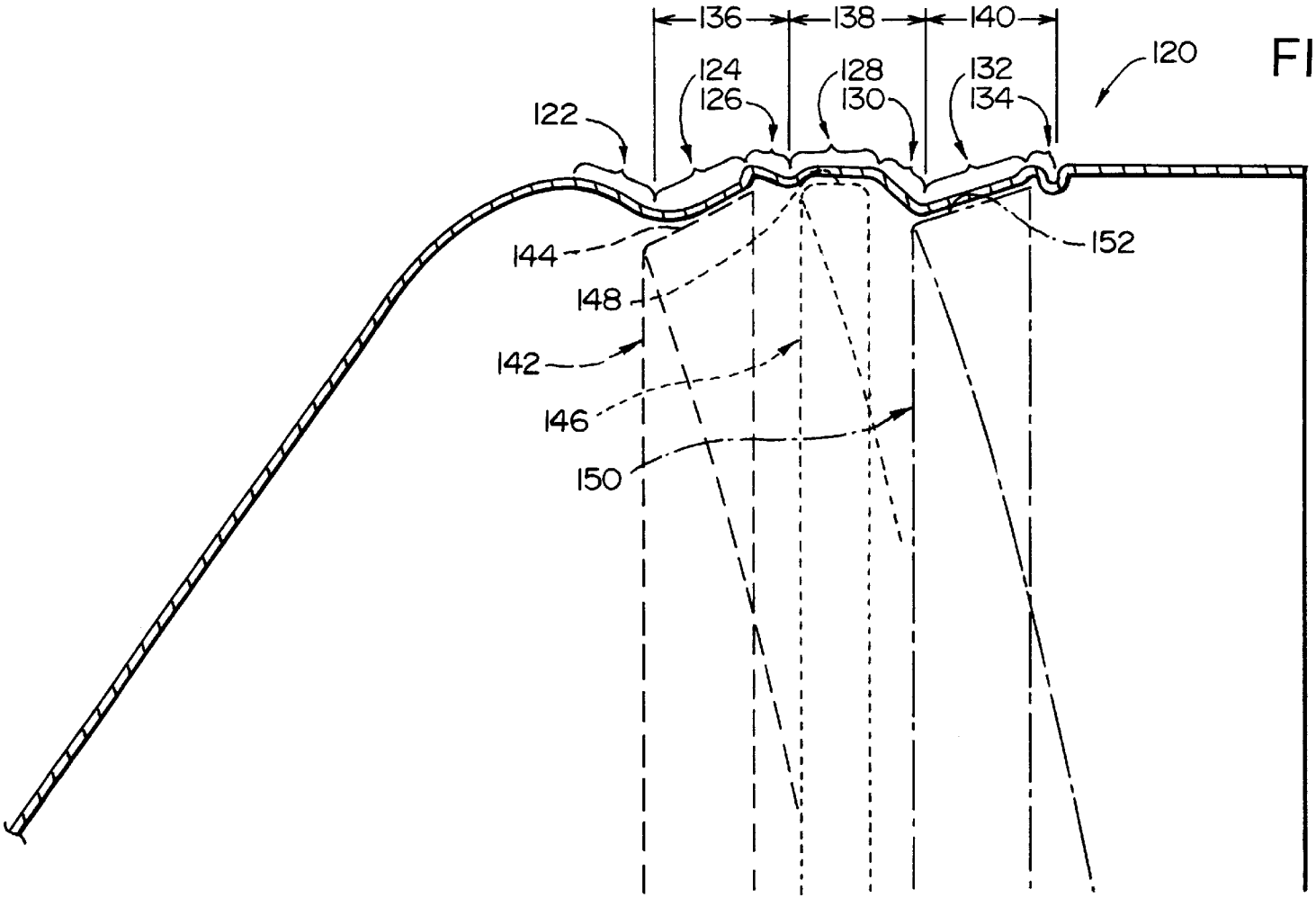
FIG. 12 is an enlarged section view of the mounting portion of an exemplary cover assembly of the present invention.

Referring now to FIG. 12, depicted therein is yet another exemplary mounting portion 120 that may be used in place of the mounting portion 52 of the cover assembly 14*a* described above. The mounting portion 120 differs from the mounting portion 52 in that the mounting portion 120 is more specifically configured to adapt to particular styles of satellite dishes currently available in the market place.

The mounting portion 120 comprises a plurality of wall portions that define a plurality of mounting areas. In particular, the cover assembly 14*a* employing the mounting portion 120 is provided with an interior wall 122, a first edge wall 124, a first transition wall 126, a second edge wall 128, a second transition wall 130, a third edge wall 132, and an outer wall 134. These walls 122–134 are configured to engage the outer edges of the three predominant styles of satellite dishes.

In particular, the first edge wall 124 and first transition wall 126 define a first mounting area 136. The first transition wall 126, second edge wall 128, and second transition wall 130 define a second mounting area 138. The third edge wall 132 and the outer wall 134 define a third mounting area 140.

The first edge wall 124 is canted with respect to the axis A of a first style 142 of satellite dish because an edge surface 144 of this dish style 142 is canted at a similar angle. The first edge wall 124 thus engages the dish edge 144 and holds the dish against the first transition wall 126 and within the first mounting area 136.

The second edge wall 128 is substantially parallel to the axis A of a second style 146 of satellite dish because an edge surface 148 of this dish style 146 is similarly parallel to the axis A. The first and second transition walls 126 and 130 engage the front and back of the dish to hold the dish within the second mounting area 138.

The third edge wall 132 is canted with respect to the axis A of a third style 150 of satellite dish because an edge surface 152 of this dish style 150 is canted at a similar angle. The third edge wall 132 thus engages the dish edge 152 and holds the dish against the rear wall 134 and within the third mounting area 140.

Figure 13:
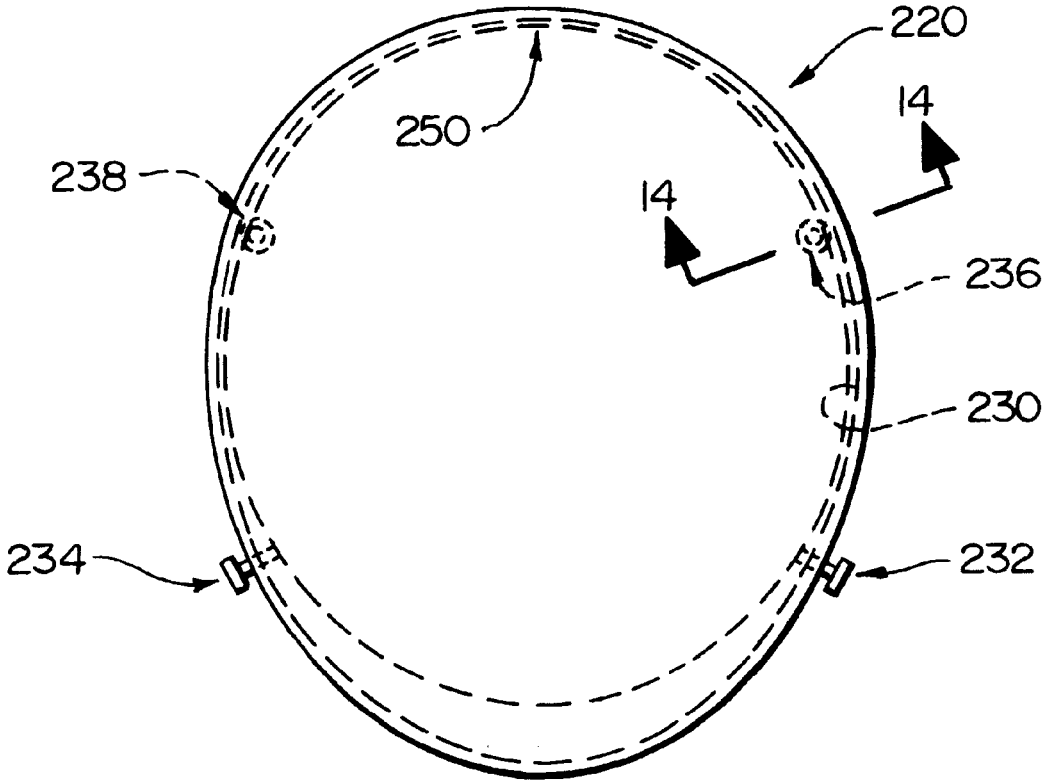
FIG. 13 is somewhat schematic front plan view depicting another exemplary cover assembly constructed in accordance with the principles of the present invention.

Referring now to FIG. 13, depicted at 220 therein is yet another mounting portion that may be used in place of the mounting portion 52 described above. The mounting portion 120 differs from the mounting portion 52 in that the mounting portion 220 defines a single mounting area sized and dimensioned to accommodate any one of the dish profiles described above with reference to FIGS. 7 and 12.

Figure 14:
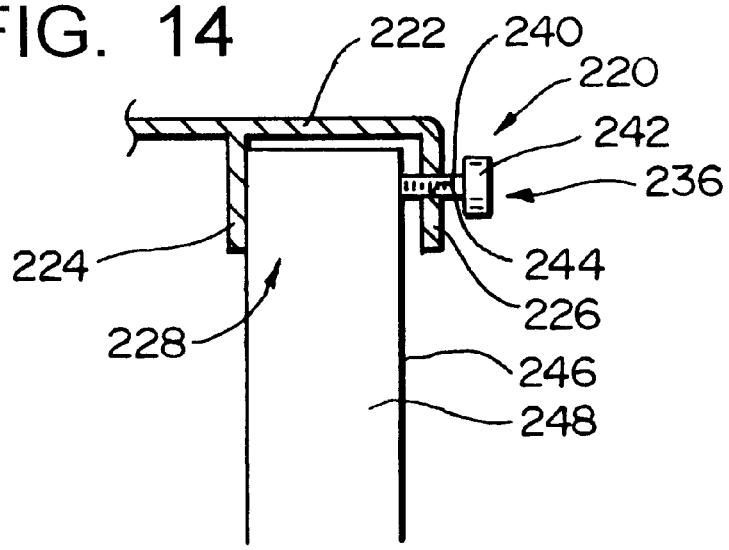
FIG. 14 is an enlarged section view taken along lines 14—14 of the mounting portion of the cover assembly of FIG. 13.
Figure 18:
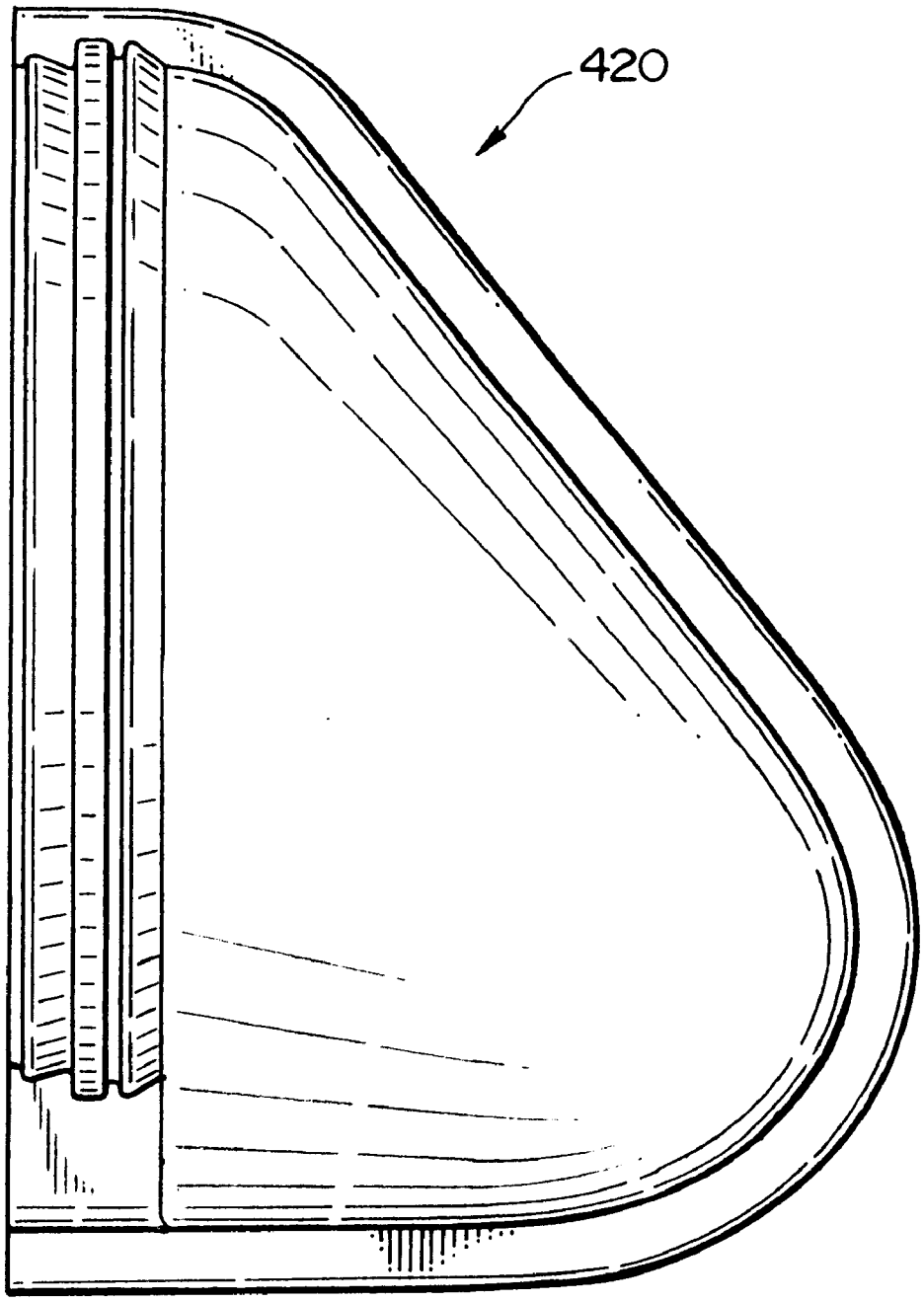
FIG. 18 is a left side elevation view depicting a configuration of a cover assembly of the present invention.
Figure 19:
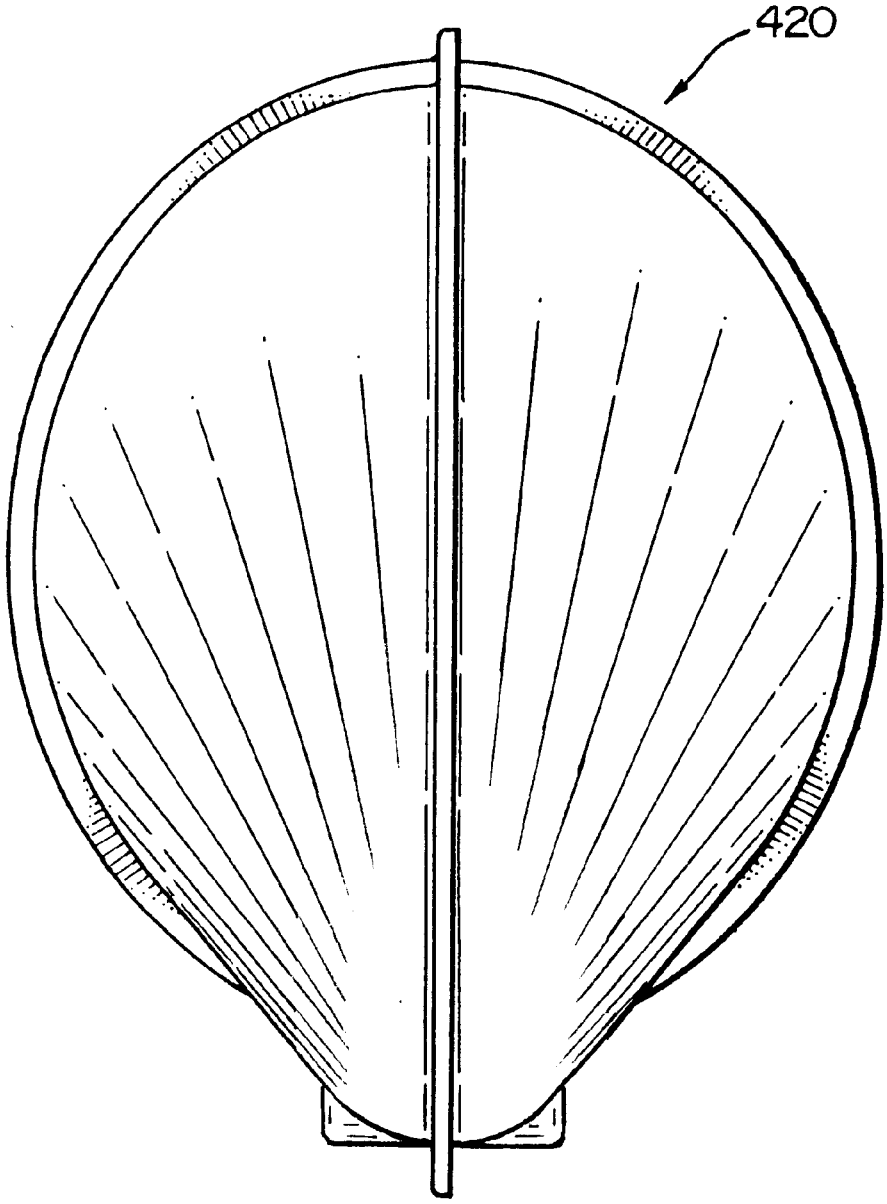
FIG. 19 is a front elevation view of the cover assembly of FIG. 18.
Figure 20:
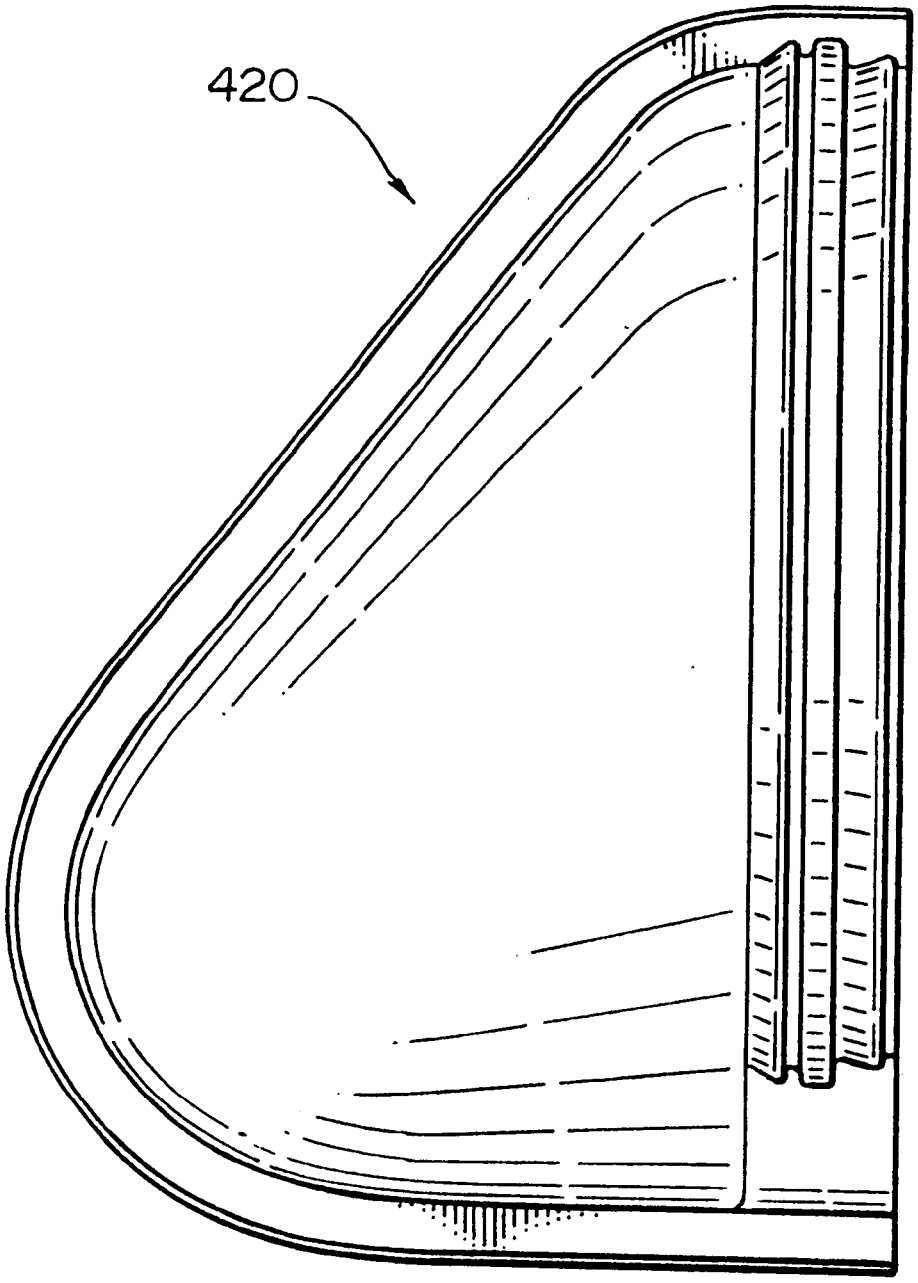
FIG. 20 is a right side elevation view of the cover assembly of FIG. 18.
Figure 21:
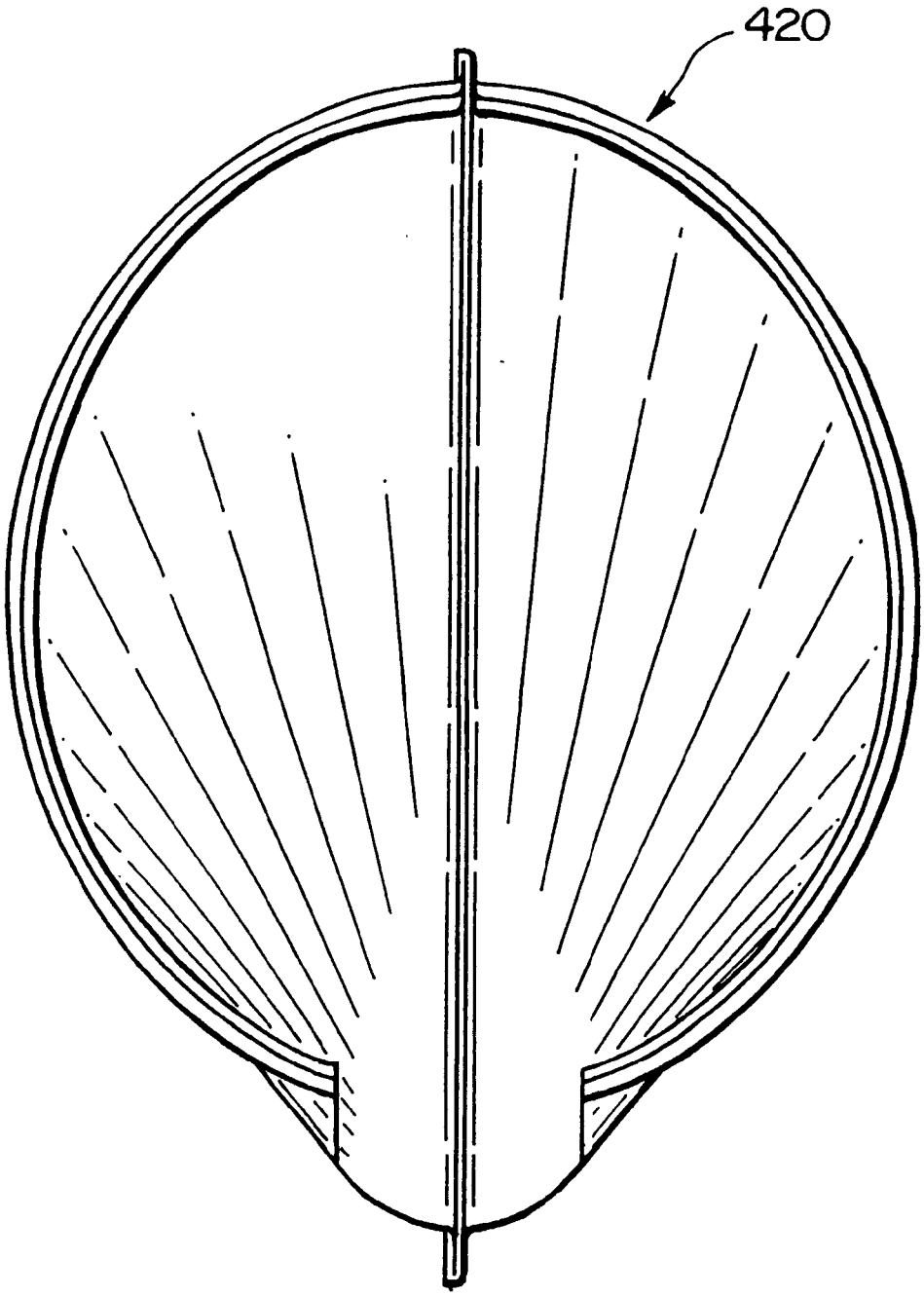
FIG. 21 is a rear elevation view of the cover assembly of FIG. 18.
Figure 22:
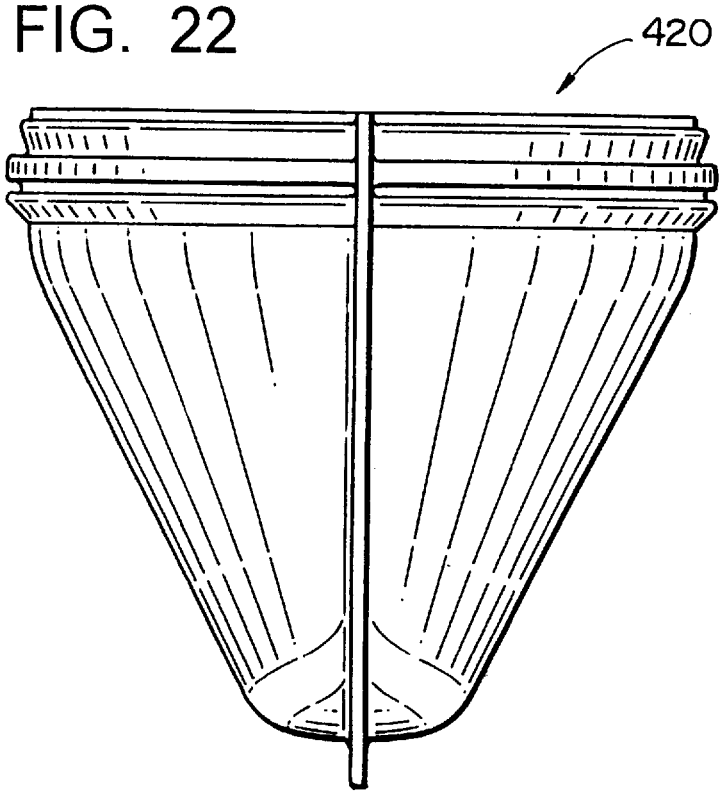
FIG. 22 is a top plan view of the cover assembly of FIG. 18.
Figure 23:
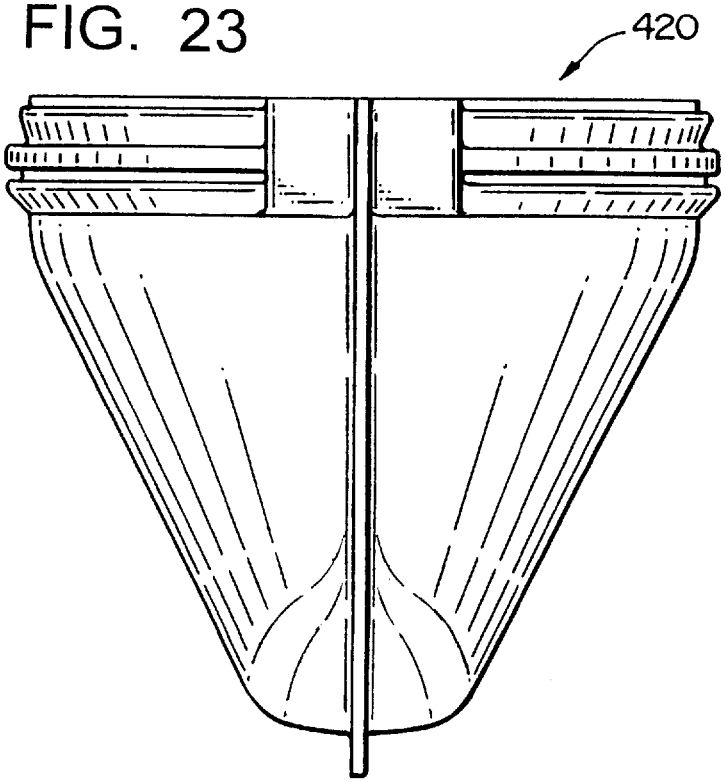
FIG. 23 is a bottom plan view of the cover assembly of FIG. 18.

In particular, as perhaps best shown in FIG. 14, the mounting portion 220 comprises a perimeter wall 222, an inner wall 224, and an outer wall 226. These walls 222–226 defining a single mounting area 228.

The perimeter wall 222 has a mounting profile 230 as indicated by the broken line 230 in FIG. 13. The mounting profile 228 is obtained by the following process. First, the antenna profiles 27*a*, 27*b*, and 27*c* are overlayed such that the uppermost points on each of these profiles 27*a*, 27*b*, and 27*c* are aligned as shown in FIG. 7. The mounting profile 228 is then obtained by drawing a closed line that extends through a 360 degree arc and which follows the outermost of the profiles 27*a*, 27*b*, and 27*c*. The mounting profile 230 of this shape ensures that, at a minimum, the mounting area 228 will accommodate any one the antenna profiles 27*a*, 27*b*, and 27*c* when the cover assembly 14*a* is formed.

For the smaller of the antenna profiles, however, the cover assembly employing the mounting portion 220 will only loosely fit the antenna assembly. The mounting assembly would move up relative to the antenna assembly and possibly rotate about the antenna axis A. Even with the largest of the antenna profiles, the fit will not be entirely snug, and slight upward and rotational movement may be possible.

Accordingly, the mounting portion 220 further preferably comprises at least one mounting clamp member that engages the dish assembly to help fix the cover assembly onto the dish assembly.

The exemplary mounting portion 220 comprises first and second side clamp members 232 and 234 and first and second edge clamp members 236 and 238. The exemplary clamp members 232–238 are identical, and only the clamp member 236 will be described in detail herein.

The clamp member 236 is a bolt-like member having a threaded portion 240 and a handle portion 242. The threaded portion 240 extends through a tapped hole 244 formed in the outer wall 226. Turning the handle portion 242 causes axial rotation of the threaded portion 240, which in turn engages the tapped hole 244 to displace the clamp member 236 along its axis. Eventually, the threaded portion 240 engages a rear side 246 of the dish assembly 248 to clamp an edge thereof against the inner wall 224.

The second edge clamp member 238 works in the same manner as the edge clamp assembly 236 and is spaced from the edge clamp assembly 236 to distribute the edge clamping forces about the perimeter of the dish assembly.

The side clamp members engage their corresponding tapped holes in a similar manner but engage the side of the dish assembly such that the dish assembly is forced against the perimeter wall 222 at at least two, and preferably three, locations. In particular, the first and second side clamp members 232 and 234 are symmetrically spaced towards the bottom of the cover assembly 220 at locations vertically spaced approximately one-third of the distance between the uppermost and lowermost points on the cover assembly 220. When tightened, the first and second side clamp members 232 and 234 force the dish assembly against the perimeter wall 222 at a location identified by reference character 250 in FIG. 13. The mounting portion 220 thus engages the antenna assembly at three locations to ensure a snug fit.

At a minimum, one clamp member may be used to securely attach the cover assembly onto an antenna assembly. The attachment becomes more secure with each additional clamp member used, with four clamp members as shown in FIG. 13 being the optimum.

A number of alternatives to the clamp members as described with reference to FIG. 14 are possible. As one example, an over the center type clamp assembly may be used. As another example, a preloaded detent member can be formed in the perimeter, inner, and/or outer walls such that the detent member engages the edge of the dish assembly and forces the associated wall away from the dish edge. In each of these cases, the dish edge is clamped or acted on in a manner that results in a snug fit even though the perimeter wall does not exactly follow the profile of the dish assembly.

Referring now to FIG. 15, depicted at 320 therein is another exemplary cover member that may be used as part of a cover assembly constructed in accordance with, and embodying, the principles of the present invention. The cover member 320 is similar in may respects to the cover members described above but employs an alternate exemplary fastening system 322.

The fastening system 322 comprises first, second, and third fastening tabs 324, 326, and 328 and first, second, and third fastening holes 330, 332, and 334. The fastening tabs 324–328 are formed on a bridge portion 336 of the cover member 320 between an upper portion 338 and a tip portion 340 thereof. The first fastening hole 330 is formed at the upper portion 338, while the second fastening hole 332 is formed at the tip portion 340. The third fastening hole 334 is formed at a lower portion 342 of the cover member 320, with the second fastening hole being spaced between the first and third fastening holes 330 and 334 along a perimeter of the cover member 320.

As shown in FIG. 16, the fastening system 322 further comprises a first vertical wall 344, an intermediate wall 346, and a second vertical wall 348. The first vertical wall 344 extends outwardly from an outer wall 350 of the cover member 320 along a portion of the perimeter of the cover member 320, with the intermediate wall 346 configured to extend between the first and second vertical walls 344 and 348.

As shown in FIG. 17, the fastening tabs 324–328 are formed in the intermediate wall 346 adjacent to the second vertical wall 348. The fastening holes 330–334 are formed in the first vertical wall 344 at the locations described above.

Referring again to FIGS. 16 and 17, depicted therein at 352 is another cover member adapted to mate with, and be connected to, the cover member 320 described above to form a cover assembly to be used as described above. The cover member 352 comprises a vertical fastening wall 354 that extends from an outer wall 356 of the cover member 352. The fastening wall 354 forms a part of the fastening system 322.

In particular, when the cover member 352 is attached to the cover member 320, the exemplary fastening wall 354 is sized and dimensioned to abut and substantially overlap the first vertical wall 344 along substantially its entire length. In this configuration, a portion of the fastening wall 354 is arranged between the fastening tabs 324–328 and the first vertical wall 344 to inhibit lateral movement of the cover member 352 relative to the cover member 320.

In addition, fastening holes (not shown) are formed in the fastening wall 354. These fastening holes in the wall 354 correspond in size and location to the fastening holes 330–334 described above. Accordingly, when the cover member 352 is attached to the cover member 320, the fastening holes formed in the fastening wall 354 are aligned with the fastening holes 330–334. Fasteners such as the fasteners 90 described above are passed through the aligned fastening holes to prevent relative vertical movement between the cover members 320 and 352.

The fastening system 322 thus securely and simply attaches the cover members 320 and 352 together so that they will remain in place on the desired antenna assembly.

Referring now to FIGS. 18–23, depicted therein is an exemplary cover assembly 420 constructed in accordance with, and embodying, the principles of the present invention. FIGS. 18–23 depict, in addition to many of the utilitarian features described above, certain ornamental features of the cover assembly 420.

From the foregoing, one of ordinary skill in the art will recognize that the present invention may be embodied in forms other than those described above and still fall within the principles of the present invention.

In particular, the exemplary cover assembly 24 may be made in one or two parts as described above. The exemplary cover assembly 24 is also a simple mechanical part but could be provided with a heating element capable of melting snow, ice, and the like that collects on the cover members 46 and 48; with the preferred materials, this heating element should not heat the cover assembly to a temperature above 130° F. Optionally, a flexible cover may be provided to cover the support arm notch 68 and thereby prevent birds, wind, and wind driven precipitation from entering the nose chamber 70*a* through the support arm notch 68.

The scope of the present invention should thus not be limited to the specific embodiments disclosed above.

We claim:

1. A cover for an antenna assembly having a dish member, a converter assembly for converting radio signals to electrical signals, and a support arm for mounting the converter assembly at a focal point of the dish member, the cover comprising a body made of rigid, waterproof material that is permeable to radio signals, the body comprising a nose portion and a mounting portion, where the mounting portion is adapted to engage the dish member such that the nose portion extends from the mounting portion around a substantial portion of the converter assembly and the body is sufficiently rigid that the nose portion of the body does not deform during normal use.

2. A cover as recited in claim 1, in which the body is an assembly comprising first and second cover members joined together along a seam.

3. A cover as recited in claim 2, further comprising a fastening system for joining the cover members along the seam.

4. A cover as recited in claim 3, in which the fastening system comprising fasteners that extend through the first and second cover members to join the cover members together.

5. A cover as recited in claim 4, in which the fastening system comprises flanges that extend from the first and second cover members along at least a portion of the seam, where the flanges abut each other when the first and second cover members are joined together and the fasteners extend through the flanges.

6. A cover as recited in claim 3, in which the fastening system comprises flanges that extend from the first and second cover members along a least a portion of the seam, where the flanges abut each other when the first and second cover members are joined together.

7. A cover as recited in claim 2, further comprising a seal member arranged along the seam to inhibit penetration of water through the seam.

8. A cover as recited in claim 1, in which the mounting portion is adapted to engage a plurality of different dish member profiles.

9. A method of covering an antenna assembly having a dish member, a converter assembly for converting radio signals to electrical signals, and a support arm for mounting the converter assembly at a focal point of the dish member, the method comprising the steps of:

providing a body made of rigid, waterproof material that is permeable to radio signals, the body comprising a nose portion and a mounting portion; and displacing the body such that the mounting portion engages the dish member such that the nose portion extends from the mounting portion around a substantial portion of the converter assembly; wherein the body is sufficiently rigid that the nose portion of the body does not deform during normal use.

10. A method as recited in claim 9, in which the step of providing the body comprises the steps of:

providing first and second cover members; and joining the first and second cover members together along a seam.

11. A method as recited in claim 10, in which the step of joining the first and second cover members together along a seam comprises the step of extending fasteners through the first and second cover members to join the cover members together.

12. A method cover as recited in claim 10, further comprising the step of sealing the seam to inhibit penetration of water through the seam.

13. A cover for an antenna assembly having a dish member, a converter assembly for converting radio signals to electrical signals, and a support arm for mounting the converter assembly at a focal point of the dish member, the cover comprising:

a body comprised of first and second cover members made of rigid, waterproof material that is permeable to radio signals, the body defining a nose portion and a mounting portion; and a fastening assembly for engaging the first and second cover members to attach the first and second cover members together such that the mounting portion engages the dish member and the nose portion extends from the mounting portion around a substantial portion of the converter assembly; wherein the body is sufficiently rigid that the nose portion of the body does not deform during normal use.

14. A method of covering an antenna assembly having a dish member, a converter assembly for converting radio signals to electrical signals, and a support arm for mounting the converter assembly at a focal point of the dish member, the method comprising the steps of:

providing first and second cover members made of rigid, waterproof material that is permeable to radio signals;

arranging the first and second cover members relative to the dish member such that the cover members form a body assembly defining a nose portion and a mounting portion that engages the dish member such that the nose portion extends around a substantial portion of the converter assembly; and joining the first and second body members together along a seam such that the body is securely attached to the dish member; wherein the body is sufficiently rigid that the nose portion of the body does not deform during normal use.

15. A method as recited in claim 14, in which the step of joining the first and second cover members together along the seam comprises the step of extending fasteners through the first and second cover members to join the cover members together.

16. A method cover as recited in claim 14, further comprising the step of sealing the seam to inhibit penetration of water through the seam.

17. A cover for an antenna assembly having a dish member, a converter assembly for converting radio signals to electrical signals, and a support arm for mounting the converter assembly at a focal point of the dish member, the cover comprising a body made of rigid, waterproof material that is permeable to radio signals, the body comprising a nose portion and a mounting portion, where the mounting portion is adapted to engage the dish member such that the nose portion extends from the mounting portion around a substantial portion of the converter assembly, and where the mounting portion comprises a plurality of grooves and each groove is adapted to snugly receive a dish member profile selected from a plurality of different dish member profiles.

18. A cover for an antenna assembly having a dish member, a converter assembly for converting radio signals to electrical signals, and a support arm for mounting the converter assembly at a focal point of the dish member, the cover comprising a body made of rigid, waterproof material that is permeable to radio signals, the body comprising a nose portion and a mounting portion, where the mounting portion is adapted to engage the dish member such that the nose portion extends from the mounting portion around a substantial portion of the converter assembly, and where the mounting portion is adapted to engage a plurality of different dish member profiles and comprises a groove adapted to accommodate each of the plurality of different dish member profiles, where the mounting portion further comprises clamp means for engaging the dish member to secure the cover on the dish member.

19. A method of covering an antenna assembly having a dish member, a converter assembly for converting radio signals to electrical signals, and a support arm for mounting the converter assembly at a focal point of the dish member, the method comprising the steps of:

providing a body made of rigid, waterproof material that is permeable to radio signals, the body comprising a nose portion and a mounting portion, the step of providing the body comprising the steps of predetermining a dish member profile for each of a plurality of antenna assemblies, and forming a plurality of grooves to define the mounting portion of the body, each groove being adapted to snugly receive a different dish member profile; and displacing the body such that the mounting portion engages the dish member such that the nose portion extends from the mounting portion around a substantial portion of the converter assembly, the step of displacing the body comprising the steps of selecting one of the grooves based on the dish member profile associated with the antenna assembly to which the cover is to be attached, and displacing the body such that dish member of the antenna assembly to which the cover is to be attached is received within the selected groove.

20. A method of covering an antenna assembly having a dish member, a converter assembly for converting radio signals to electrical signals, and a support arm for mounting the converter assembly at a focal point of the dish member, the method comprising the steps of:

providing a body made of rigid, waterproof material that is permeable to radio signals, the body comprising a nose portion and a mounting portion, the step of providing the body comprising the step of forming a groove adapted to accommodate each of a plurality of different dish member profiles; and displacing the body such that the mounting portion engages the dish member such that the nose portion extends from the mounting portion around a substantial portion of the converter assembly, the step of displacing the body comprising the steps of displacing the body such that the dish member of the antenna assembly to which the cover is to be attached is received within the groove, and clamping the body to the dish member to secure the cover on the dish member.

21. A cover for an antenna assembly having a dish member, a converter assembly for converting radio signals to electrical signals, and a support arm for mounting the converter assembly at a focal point of the dish member, the cover comprising:

a body comprised of first and second cover members made of rigid, waterproof material that is permeable to radio signals, the body defining a nose portion and a mounting portion; and a fastening assembly for engaging the first and second cover members to attach the first and second cover members together such that the mounting portion engages the dish member and the nose portion extends from the mounting portion around a substantial portion of the converter assembly; wherein the mounting portion comprises a plurality of grooves, each groove being adapted to snugly received a different dish member profile.

22. A cover for an antenna assembly having a dish member, a converter assembly for converting radio signals to electrical signals, and a support arm for mounting the converter assembly at a focal point of the dish member, the cover comprising:

a body comprised of first and second cover members made of rigid, waterproof material that is permeable to radio signals, the body defining a nose portion and a mounting portion; and a fastening assembly for engaging the first and second cover members to attach the first and second cover members together such that the mounting portion engages the dish member and the nose portion extends from the mounting portion around a substantial portion of the converter assembly; wherein the mounting portion comprises a groove adapted to accommodate each of the plurality of different dish member profiles, where the mounting portion further comprises clamp means for engaging the dish member to secure the cover on the dish member.

23. A method of covering an antenna assembly having a dish member, a converter assembly for converting radio signals to electrical signals, and a support arm for mounting the converter assembly at a focal point of the dish member, the method comprising the steps of:

providing first and second cover members made of rigid, waterproof material that is permeable to radio signals, where the step of providing the first and second cover members comprises the steps of:

predetermining a dish member profile for each of a plurality of antenna assemblies, and forming a plurality of grooves in the cover members to define the mounting portion of the body assembly, each groove being adapted to snugly receive a different dish member profile;

arranging the first and second cover members relative to the dish member such that the cover members form a body assembly defining a nose portion and a mounting portion that engages the dish member such that the nose portion extends around a substantial portion of the converter assembly, where the step of arranging the cover members comprises the steps of selecting one of the grooves based on the dish member profile associated with the antenna assembly to which the cover is to be attached, and displacing the cover members such that dish member of the antenna assembly to which the cover is to be attached is received within the selected groove; and joining the first and second body members together along a seam such that the body is securely attached to the dish member.

24. A method of covering an antenna assembly having a dish member, a converter assembly for converting radio signals to electrical signals, and a support arm for mounting the converter assembly at a focal point of the dish member, the method comprising the steps of:

providing first and second cover members made of rigid, waterproof material that is permeable to radio signals, where the step of providing the cover members comprises the step of forming grooves in the cover members adapted to accommodate each of a plurality of different dish member profiles;

arranging the first and second cover members relative to the dish member such that the cover members form a body assembly defining a nose portion and a mounting portion that engages the dish member such that the nose portion extends around a substantial portion of the converter assembly, where the step of arranging the cover members comprises the steps of displacing the cover members such that the dish member of the antenna assembly to which the cover is to be attached is received within the groove, and clamping the body to the dish member to secure the cover on the dish member; and joining the first and second body members together along a seam such that the body is securely attached to the dish member.

* * * * *